US005372359A

United States Patent [19]

Miura et al.

[11] Patent Number: 5,372,359

[45] Date of Patent: Dec. 13, 1994

[54] SHEET FEEDING APPARATUS

[75] Inventors: Yoshifumi Miura; Takeshi Hayashida, both of Kurume, Japan

[73] Assignee: Matsushita Electric Industrial Co., Ltd., Osaka, Japan

[21] Appl. No.: 26,700

[22] Filed: Mar. 5, 1993

[30] Foreign Application Priority Data

Mar. 11, 1992 [JP] Japan ..... 4-052558

[51] Int. Cl.[5] ..... B65H 3/00

[52] U.S. Cl. ..... 271/119; 271/121

[58] Field of Search ..... 271/119–121, 271/167; 221/43, 259, 277; 492/30, 38, 33, 34

[56] References Cited

U.S. PATENT DOCUMENTS

| | | | |
|---|---|---|---|
| 1,956,229 | 4/1934 | Sidebotham . | |
| 2,269,571 | 1/1942 | Aktabowski . | |
| 4,861,013 | 8/1989 | Shibata et al. | 271/121 X |

FOREIGN PATENT DOCUMENTS

| | | | |
|---|---|---|---|
| 0345989 | 12/1989 | European Pat. Off. . | |
| 1067451 | 10/1959 | Germany . | |
| 57-209140 | 12/1982 | Japan . | |
| 58-089531 | 5/1983 | Japan . | |
| 63-300028 | 12/1988 | Japan . | |
| 1-053955 | 3/1989 | Japan . | |
| 1321225 | 12/1989 | Japan | 271/121 |
| 2127330 | 5/1990 | Japan | 271/121 |
| 2132025 | 5/1990 | Japan | 271/121 |
| 318040 | 2/1991 | Japan . | |
| 3-158329 | 7/1991 | Japan . | |
| 3158329 | 7/1991 | Japan | 271/119 |
| 3162331 | 7/1991 | Japan | 271/119 |
| 3113336 | 11/1991 | Japan . | |

*Primary Examiner*—David H. Bollinger
*Attorney, Agent, or Firm*—Pollock, Vande Sande & Priddy

[57] ABSTRACT

A sheet feeding apparatus for intermittently feeding sheets one by one into printing equipment. The apparatus comprises a sheet pickup roller fixed to a rotatable drive shaft, a pair of cylindrical rollers rotatably and coaxially coupled to the drive shaft and disposed at both sides of the sheet pickup roller, and a pad biased by a spring to be pressed against the sheet pickup roller and the cylindrical rollers. The sheet pickup roller has a cross section comprising an arc portion and a chord portion to substantially form a semicylindrical configuration. Also included in the apparatus is a projection provided at the chord portion of the sheet pickup roller. The projection is arranged to come into contact with the sheet over a range from a contact point between the sheet pickup roller and the pad to one end portion of the arc portion which acts as a leading portion at which the sheet pickup roller initially comes into contact with the sheet when rotating in a predetermined direction.

15 Claims, 8 Drawing Sheets

SHEET FEEDING APPARATUS

BACKGROUND OF THE INVENTION

The present invention relates to a sheet feeding apparatus to separate and feed individual sheets in a sheet storage device, and more particularly to a sheet feeding apparatus which is of the type that intermittently and separately supplies sheets from a storage device through a semicylindrical pickup roller to office automation equipment such as a printer.

An important problem in the sheet feeding art relates to stable and accurate feeding of sheets from a sheet storage device to equipment. Here, a description will be made with reference to FIGS. 13 to 16 in terms of an arrangement of a conventional sheet feeding apparatus and a problem inherent to such a conventional sheet feeding apparatus. In FIGS. 13 and 14, in response to setting a sheet-loaded sheet storage device 121 to a body of a laser printer 111, a sheet feeding apparatus, designated at numeral 141, supplies the laser printer 111 with sheets 123 pushed up by a push-up spring 122. The sheet feeding apparatus 141 comprises a semicylindrical pickup roller 144 coaxially fixed to a drive shaft 142, a stopping roller 147 disposed at both end portions (sides) of the semicylindrical pickup roller 144 and coaxially and rotatably couped to the drive shaft 142, a retard pad 146 disposed to be elastically brought into contact with the circumference of the semicylindrical pickup roller 144 by means of elastic members (springs) 145, and a sheet guide plate 148 for rotatably supporting the retard pad 146 to guide the sheets 123. The sheets 123 fed from the sheet feeding apparatus 141 are supplied through a carrying roller 149 into the body of the laser printer 111.

FIG. 15 is a cross-sectional illustration of the semicylindrical pickup roller 144 taken along a line X—X in FIG. 14. In FIG. 15, the semicylindrical pickup roller 144, being made of a rubber, is arranged to have a diameter slightly greater than the diameter of the stopping roller 147 and fixedly coupled through a core member 143 to the drive shaft 142. Further, the semicylindrical pickup roller 144 has a plurality of grooves **144*a* formed along its axis and has a notch 144*c***.

In operation, the sheets 123 placed in the sheet storage device 121, as mentioned above, are pushed up by the push-up spring 122 to be pressed against the stopping roller 147 whereby the sheets 123 are positioned for supply. Then, the semicylindrical pickup roller 144 is rotated by one revolution in a direction indicated by an arrow in FIG. 13, whereby a leading portion **144*b* of the semicylindrical pickup roller 144 comes into contact with a front portion of the uppermost (topmost) sheet 123 so that the uppermost sheet 123 is moved forwardly by means of a frictional force relative to the semicylindrical pickup roller 144. At this time, the retard pad 146 comes into contact with the sheets 123 other than the uppermost sheet 123 to suppress the supply of the sheets 123 by means of a sliding resistance to prevent the following sheets 123 from being supplied simultaneously with the uppermost sheet 123**.

There is a problem which arises with such a sheet feeding apparatus, however, in that, in cases where the rigidity of the sheets 123 is low, when the second sheet 123 follows the uppermost sheet 123 moved forwardly by the semicylindrical pickup roller 144, the second sheet floats or rises as illustrated in FIG. 16 whereby the aforementioned sliding resistance between the retard pad 146 and the sheet 123 becomes low, that is, the retard pad 146 does not fulfil its function, to result in allowing the simultaneous supply of the more than one sheet 123.

SUMMARY OF THE INVENTION

It is therefore an object of the present invention to provide a sheet feeding apparatus which is capable of preventing simultaneous supply of more than one sheet irrespective of the rigidity of the sheets.

One feature of this invention is that a projection is provided at a leading portion of a sheet pickup roller so as to prevent sheets from floating to avoid the simultaneous supply of the sheets.

According to the present invention, there is provided a sheet feeding roller having a cross section comprising an arc portion and a chord portion to substantially form a semicylindrical configuration, the sheet feeding roller being equipped with a projection at the chord portion and the projection being made of a material different from a material of the arc portion. A circumferential surface of the projection is arranged to have a coefficient of friction smaller than a coefficient of friction of the material of the arc portion.

Further, in accordance with this invention, there is provided a sheet feeding apparatus for intermittently feeding sheets, comprising: a sheet pickup roller fixed to a rotatable drive shaft and having a cross section comprising an arc portion and a chord portion to substantially form a semicylindrical configuration; cylindrical roller means rotatably coupled to the rotatable drive shaft and disposed at both sides of the sheet pickup roller; a pad biased by elastic means to be pressed against the sheet pickup roller and the cylindrical roller means; and a projection provided at the chord portion of the sheet pickup roller, the projection being arranged to come into contact with the sheet in response to rotation of the sheet pickup roller in a predetermined direction.

The projection has a length in its cross section to come into contact with the sheet over a range from a contact point between the sheet pickup roller and the pad to one end portion of the arc portion which acts as a leading portion at which the sheet pickup roller initially comes into contact with the sheet when rotating in a predetermined direction. An outer surface of the projection is lowered in cross-sectional height from a circumferential portion of the cylindrical roller means or protruded by a predetermined distance from the circumferential portion of the cylindrical roller means. Further, a film is adhered onto an outer surface of the projection, the film having a coefficient of friction smaller than a coefficient of friction of the sheet pickup roller.

Moreover, according to this invention, there is provided a sheet feeding apparatus for intermittently feeding sheets, comprising: a sheet pickup roller fixed to a rotatable drive shaft and having a cross section comprising an arc portion and a chord portion to substantially form a semicylindrical configuration; cylindrical roller means rotatably coupled to the rotatable drive shaft and disposed at both sides of the sheet pickup roller; a pad biased by elastic means to be pressed against the sheet pickup roller and the cylindrical roller means; and a guide member provided at the chord portion to extend along an axis of the sheet pickup roller, the guide member has a width to come into contact with the sheet over a range from a contact point between the sheet pickup roller and the pad to one end portion of the arc portion which acts as a leading portion at which the sheet pickup roller initially comes into contact with the sheet when rotating in a predetermined direction.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
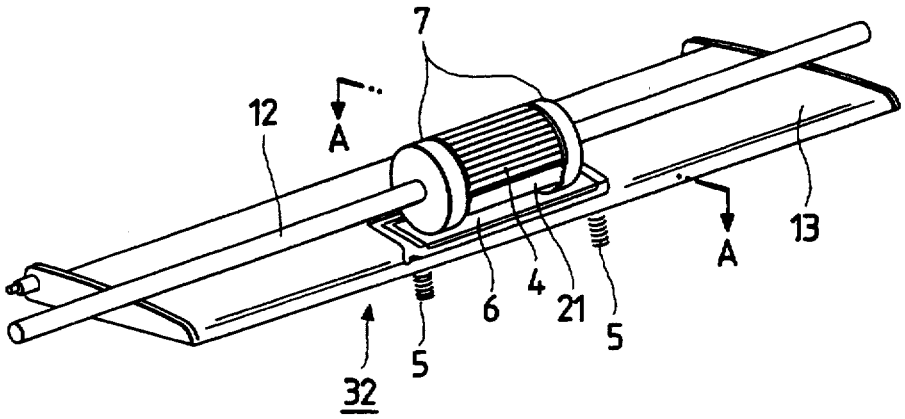
FIG. 1 is a perspective view showing a sheet feeding apparatus according to a first embodiment of this invention.
Figure 2:
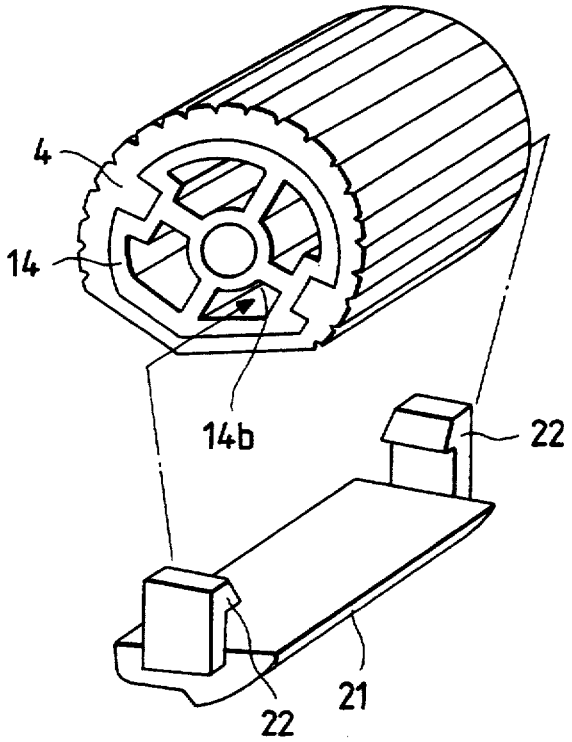
FIG. 2 is an enlarged view showing a sheet pickup roller and a guide member in the sheet feeding apparatus of the first embodiment of this invention.
Figure 3:
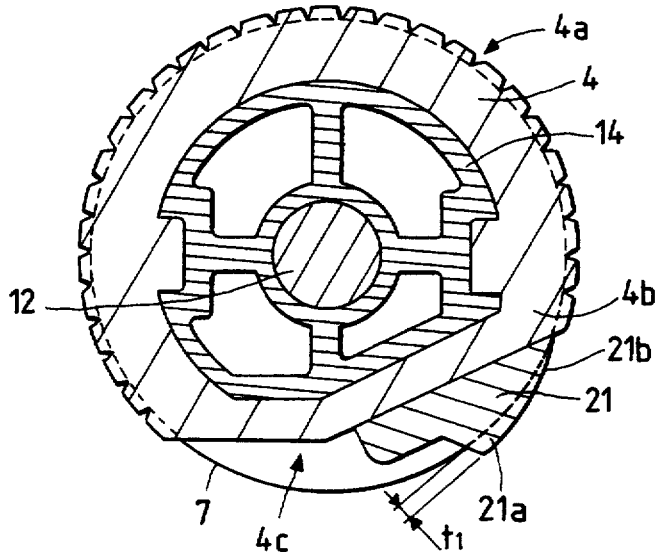
FIG. 3 is a cross-sectional view showing an arrangement of the sheet pickup roller of the sheet feeding apparatus in the first embodiment of this invention.

Referring now to FIGS. 1 to 3, a description will be made herein below in terms of a sheet feeding apparatus according to a first embodiment of the present invention. FIG. 1 is a perspective view showing an arrangement of the sheet feeding apparatus according to the first embodiment of this invention. As illustrated in FIG. 1, the sheet feeding apparatus, designated at numeral 32, comprises a sheet pickup roller 4 fixedly secured to a drive shaft 12, a guide member 21 attached to a leading portion 4*b* of the sheet pickup roller 4 in its rotational direction, a stopping roller 7 disposed at both ends of the sheet pickup roller 4 and coaxially and rotatably couped to the drive shaft 12, a retard pad 6 disposed to be elastically brought into contact with the circumference of the sheet pickup roller 4 by means of elastic members 5, and a sheet guide plate 13 for rotatably supporting the retard pad 6 to guide sheets to be fed to equipment. FIG. 2 is an enlarged view showing the sheet pickup roller 4. As illustrated in FIG. 2, the sheet pickup roller 4 has a notch portion to substantially form a semicylindrical configuration and is composed of an outer portion and an inner portion which are integrally and fixedly coupled to each other. The outer portion of the sheet pickup roller 4 is made of a rubber or the like, and the inner portion thereof acts as a core member 14 of the sheet pickup roller 4 having a center through-hole into which the drive shaft 12 is inserted to be fixedly secured thereto so that the sheet pickup roller 4 is coaxially coupled to the drive shaft 12 to be rotatable in accordance with rotation of the drive shaft 12. Further, the core member 14 has a plurality of caves extending along the axis of the center through-hole. The guide member 21 is equipped with claw portions 22 at its both ends. The claw portions 22 are engaged with one cave 14*b* of the core member 14 from both the sides so that the guide member 21 is detachably attached to a predetermined portion of the sheet pickup roller 4. As seen from FIG. 3 which is a cross-sectional view taken along a line A—A in FIG. 2, the sheet pickup roller 4 has a diameter slightly greater than the diameter of the stopping roller 7 and further has in its circumference (outer portion) a plurality of grooves 4*a* extending along its own axis. The guide member 21 is positioned at a portion of the notch portion (designated at 4*c*) of the sheet pickup roller 4, i.e., positioned at the vicinity of a portion 4*b* of the sheet pickup roller 4 which acts as a leading portion when the sheet pickup roller 4 rotates in a predetermined direction. The guide member 21 is made of a material such as polyacetal resin and alkyl benzene sulfonic acid type resin having a coefficient of friction smaller than that of the material of the sheet pickup roller 4. That is, the guide member 21 has a smooth surface. A tip portion 21*a* of the guide member 21 is arranged to have a thickness whereby the guide member 21 attached to the sheet pickup roller 4 slightly protrudes outwardly from the outer circumference of the stopping roller 7 or the outer surface of the guide member 21 becomes substantially equal in height to the circumferential surface of the stopping roller 7. In this embodiment, as a preferable value, the protruding amount (t1 in FIG. 3) from the outer circumference of the stopping roller 7 is arranged to be 1 to 3 times the thickness of each sheet (3) to be fed. Further, a rear end portion 21*b* of the guide member 21 is arranged to be lowered with respect to the outer circumferential surface of the sheet pickup roller 4 or arranged to be substantially equal in height to the outer circumferential surface of the sheet pickup roller 4. Preferably, the range (arc-length) of the protruding portion 21*a* of the guide member 21 is set to be substantially equal to a range from the contact point between the guide member 21 and the retard pad 6 to the leading portion 4*b* of the sheet pickup roller 4 in the state that the leading portion 4*b* of the sheet pickup roller 4 comes into contact with the sheet (3) to be fed.

Figure 4:
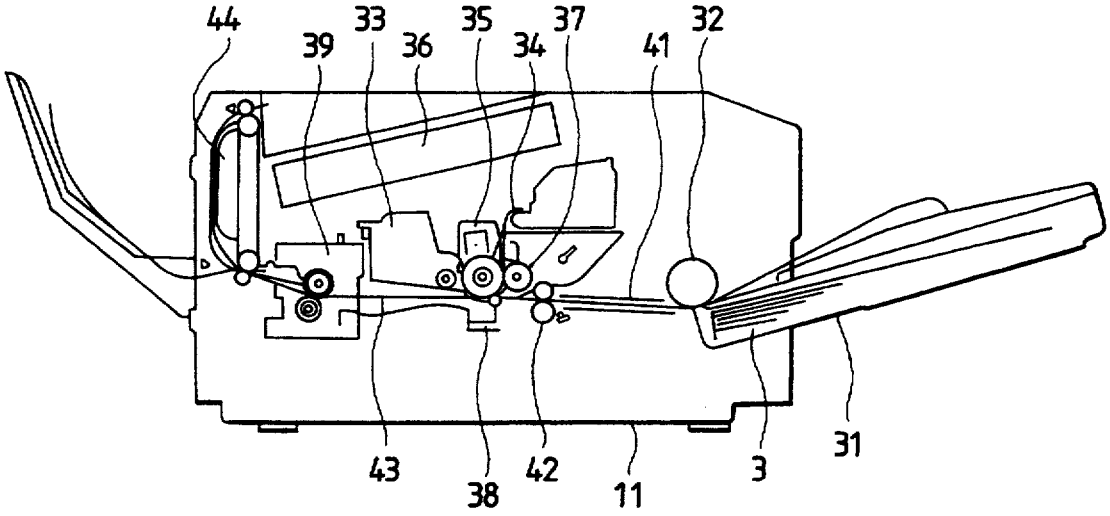
FIGS. 4 to 8 are illustrations of a laser printer using the sheet feeding apparatus according to the first embodiment of this invention.

FIG. 4 is an illustration for describing the sheet supply passage of a laser printer when using the sheet feeding apparatus 32 according to this embodiment. In FIG. 4, sheets 3 are stored in a sheet storage device 31 which is in turn loaded to the body 11 of the laser printer. The front (tip) portion of the sheet storage device 31 is coupled to the sheet feeding apparatus 32. In a carrying passage of a sheet 3 fed from the sheet feeding apparatus 32 there is disposed a resist roller 42 for temporarily stopping the sheet 3. After passing through the resist roller 42, the sheet 3 enters into a carrying passage 43 where there is disposed a charger 35 for charging a recording device (photosensitive drum) 34, an exposure device 36 for converting recording information into optical information so that the recording device 34 is illuminated with the optical information to form an electrostatic latent image on the recording device 34, a developing device for giving a developer with respect to the electrostatic latent image on the recording device 34, a transfer device 38 for transferring the developer on the recording device 34 to the sheet 3, and a fixing device 39 for heating and fixing the developer on the sheet 3. Further, at a position close to the recording device 34 there is disposed a cleaning device 33 for removing the remaining developer from the recording device 34, and at an exit of the fixing device 39 there is disposed a sheet-discharging device 44 for guiding the sheet 3 on to an upper cover of the body 11 of the laser printer.

Figure 5:
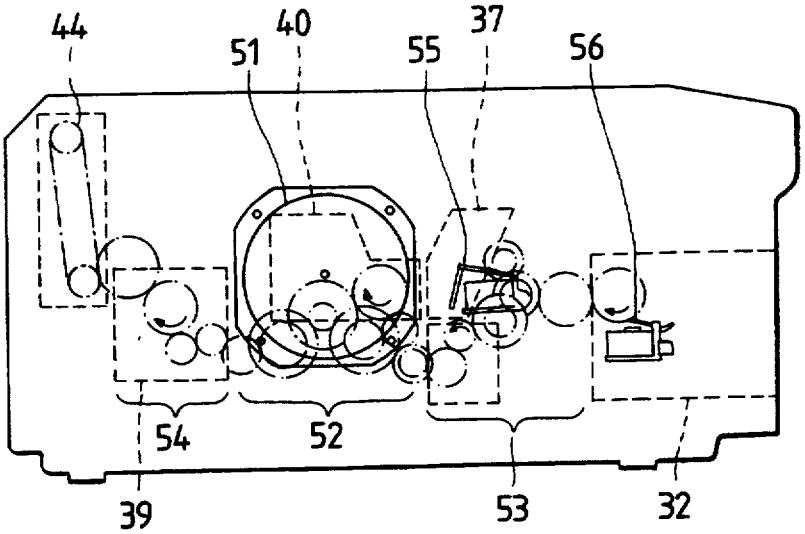

FIG. 5 shows a drive system for the supply of the sheets 3 into the laser printer body 11. In FIG. 5, a main motor 51 acts as a drive source to drive, through a first gear train 52, the recording device 34 (not shown), the developing device 37, the cleaning device 33, a second gear train 53, and a third gear train 54. The second gear train 53 operates, through a first solenoid type clutch 55, the resist roller 42 and further operates, through a second solenoid type clutch 56, the sheet feeding apparatus 32. The third gear train 54 operates the fixing device 39 and the sheet-discharging device 44.

A printing operation of the laser printer thus arranged will be described hereinbelow. In response to completion of supply of image information from a host computer (not shown), a scanner motor (not shown) of the exposure device 36 starts to rotate. When the rotational speed of the scanner motor reaches a given value and becomes stable, the main motor 51 starts to rotate to drive the recording device 34, the developing device 37, the fixing device 39, the cleaning device 33 and the sheet-discharging device 44 which are coupled to the first and third gear trains 52 and 54, thereafter start the output control of a semiconductor laser (not shown) of the exposure device 36 and the charging control of the charger 35. In this state, when the second solenoid type clutch 56 is operated, the sheet pickup roller 4 of the sheet feeding apparatus 32 rotates by one revolution whereby one sheet 3 in the sheet storage device 31 is supplied into the carrying passage 41 of the laser printer. The sheet 3 supplied takes a waiting state for printing by means of the resist roller 42. Further, the exposure device 36 starts to write the image information in the recording device 34 and the recording device 34 rotates for completely writing the image information. The image information written therein is developed by the developing device 37. On the other hand, the first solenoid type clutch 55 is operated at the timing that the front end portion of the sheet 3 supplied from the resist roller 42 is coincident with the transferring device 38, thereby starting the operation of the resist roller 42. Thereafter, the image information on the recording device 34 is transferred onto the sheet 3 in the transferring device 38. The aforementioned operation is repeatedly affected with respect to the following sheets 3. The sheet 3 on which the image information is transferred is supplied through the carrying passage 43 up to the fixing device 39. In the fixing device 39, the developer transferred on the sheet 3 is heated by a heating roller (not shown) to be fixed thereon.

Figure 6:
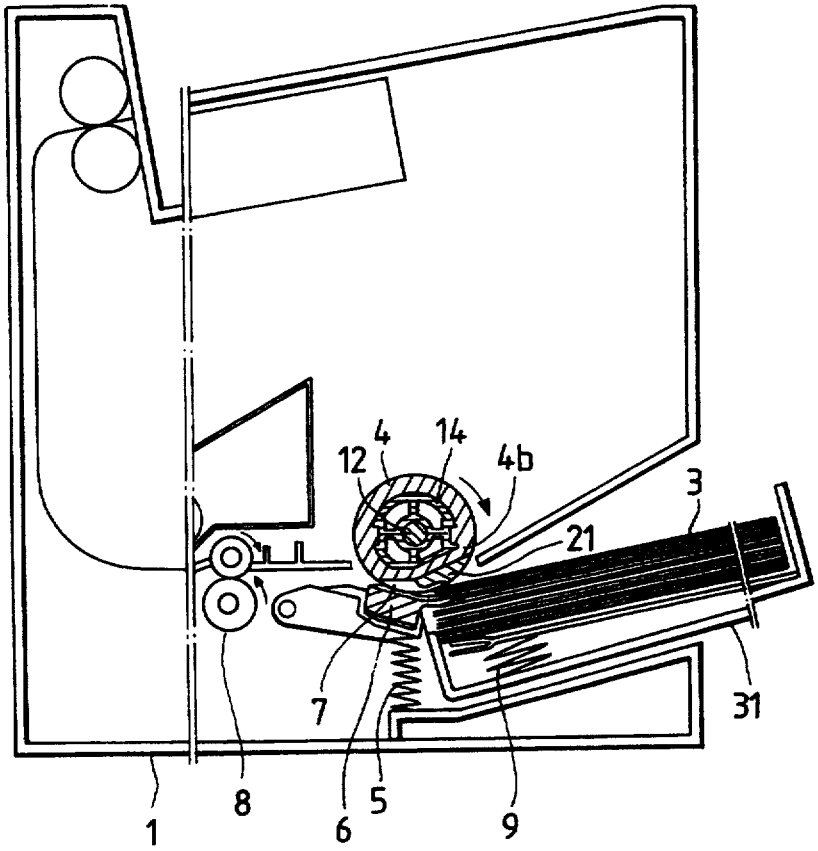
Figure 7:
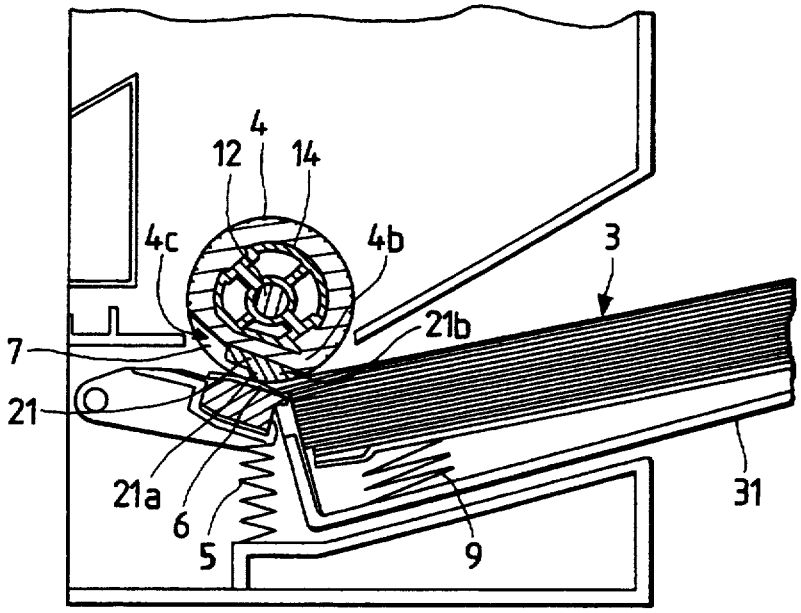
Figure 8:
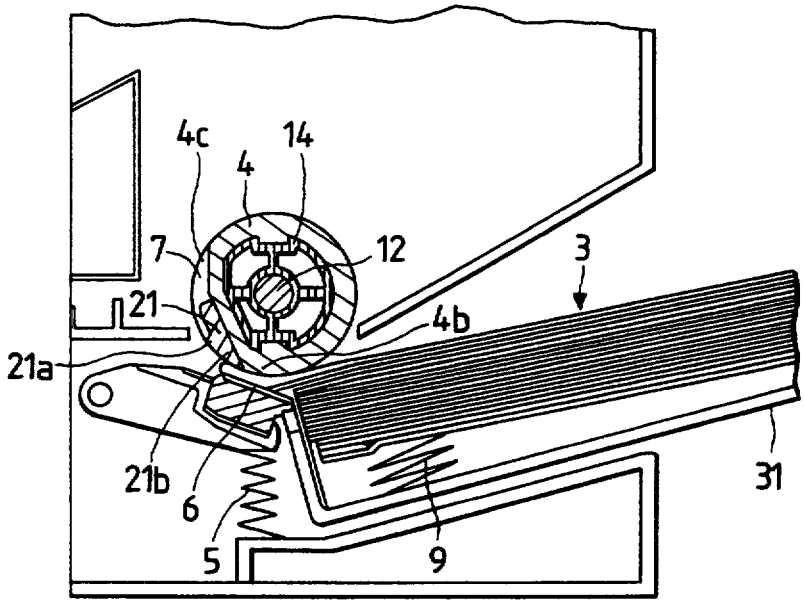

Secondly, a description will be made hereinbelow in terms of an operation of the sheet feeding apparatus 32 for feeding the sheets 3 one by one. FIG. 6 is a cross-sectional view showing a principal portion of the sheet feeding apparatus 32 which takes the waiting state. In FIG. 6, the sheets 3 stored in the sheet storage device 31 is urged by means of a push-up spring 9 to be pressed against the stopping roller 7 and positioned thereby. At this time, the guide member 21 does not yet come into contact with the sheets 3. In response to a command for start of the sheet supply, the sheet pickup roller 4 starts to rotate in a direction indicated by an arrow. FIG. 7 is a cross-sectional view showing the principal portion of the sheet feeding apparatus 32 which takes a state immediately after the start of the sheet supply. In FIG. 7, the guide member 21 presses the front portion (preceding portion) of the uppermost sheet 3 from the upper side and slightly feeds the uppermost sheet 3. Here, since the guide member 21 is made of a material whose frictional coefficient is lower than that of the sheet pickup roller 4, the uppermost sheet 3 cannot be completely forwarded. Further, since the guide member 21 is arranged to be slightly protruded from the circumference of the stopping roller 7 or to be substantially equal in height to the circumference thereof, the front portion of the sheet 3 subjected to the feeding force due to the guide member 21 can be prevented from floating and strongly guided toward the sliding surface of the retard pad 6. FIG. 8 is a cross-sectional view showing the principal portion of the sheet feeding apparatus 32 which takes a sheet-feeding state. In this sheet-feeding state, the front portion of the uppermost sheet 3 is brought into contact with the circumferential surface of the sheet pickup roller 4 to be sent out through a frictional force relative thereto, and is surely brought into contact with the retard pad 6 under a pressure due to the guide member 21. Thus, even if the uppermost sheet 3 and the second sheet 3 are integrally piled up to each other by an electrostatic suction force or friction, the retard pad 6 can surely control the second or other sheet so as to prevent the simultaneous supply of the multiple sheets 3. Thereafter, the sheet 3 sent out from the sheet feeding apparatus 32 is supplied through carrying rollers (8 in FIG. 6) into the laser printer and then carried and processed as described above.

Figure 9:
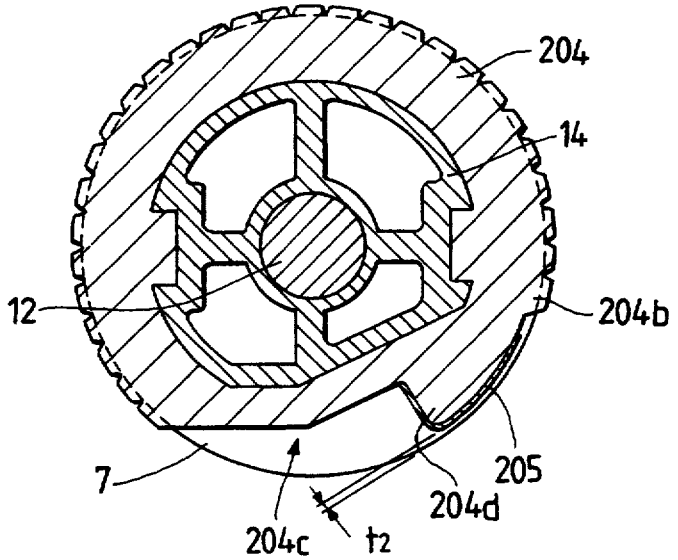
FIG. 9 is a cross-sectional view showing an arrangement of a sheet pickup roller of a sheet feeding apparatus according to a second embodiment of this invention.

In addition, a description will be made hereinbelow with reference to FIG. 9 in terms of an arrangement of a sheet feeding apparatus according to a second embodiment of this invention. FIG. 9 is a cross-sectional view taken along the line A—A in FIG. 1 where parts corresponding to those in FIG. 3 are marked with the same numerals and the description thereof will be omitted for brevity. In FIG. 9, a sheet pickup roller 204, made of a rubber or the like, has a diameter slightly greater than that of a stopping roller 7, and has a number of grooves 204*a* extending along its own axis on its circumference and has a notch portion 204*c* at a portion of the circumference. Further, the sheet pickup roller 204 has a projection 204*d* at its leading portion 204*b* which first faces sheets when rotating in a predetermined direction for the pick-up of the sheets. This projection 204*d* may be made of the same material (rubber) as the sheet pickup roller 204 body (outer portion of the sheet pickup roller 204) and may be integrally constructed together with the sheet pickup roller 204 body. The projection 204*d* has a circumferential surface (arc-shaped surface) substantially extending along the circumference of the sheet pickup roller 204 or the circumference of the stopping roller 7. Onto the circumferential surface of the projection 204*d* there is adhered a film 205 made of a material such as a resin which has a coefficient of friction smaller than that of the sheet pickup roller 204 body. Preferably, the film 205 is made of tetrafluoroethylene polymer. The circumferential surface of the film 205 is arranged to have a diameter whereby the film 205 is positioned to be slightly lowered with respect to the circumference of the stopping roller 7 or substantially become equal in height to the circumference of the stopping roller 7. Preferably, the lowered amount (12 in FIG. 9) of the film 205 is set to be 1 to 3 times the thickness of the sheet (3). The projection 204d will be effectively used when its length is set to be equal to a range from the contact point between the projection 204d (film 205) and a retard pad 6 to the leading portion 204b of the sheet pickup roller 204 in the state that the leading portion 204b of the sheet pickup roller 204 comes into contact with the sheet (3) to be fed. Here, if the sheet pickup roller 204 is made of a rubber whose elasticity is slight so that the sheet pickup roller 204 is scarcely dented, it is appropriate that the projection 204d is arranged to be similar in shape and structure to the guide member 21 in FIG. 3.

Figure 10A:
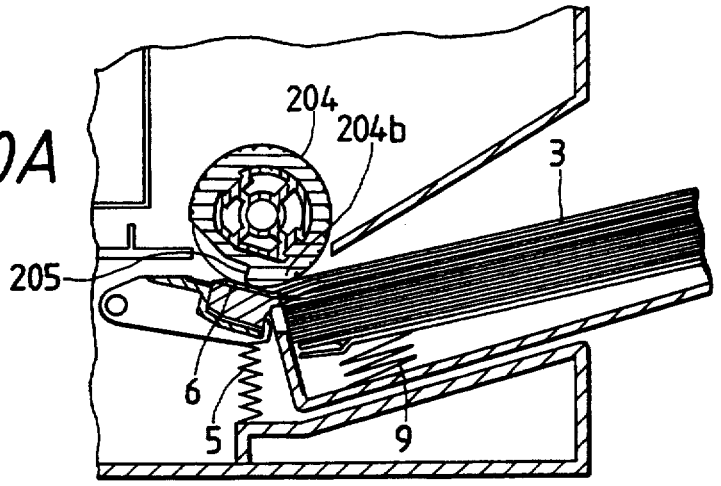
FIGS. 10A and 10B are illustrations of a laser printer equipped with the sheet feeding apparatus according to the second embodiment of this invention.
Figure 10B:
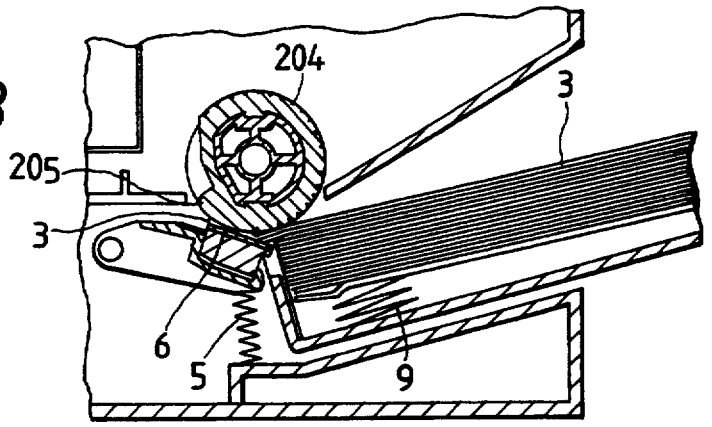

Secondly, a description will be made hereinbelow in terms of an operation of the sheet feeding apparatus for feeding sheets by one. FIG. 10A is a cross-sectional view showing the principal portion of the sheet feeding apparatus which takes a state immediately after the start of the sheet-feeding operation. In FIG. 10A, the projection 204d first presses the front portion of the uppermost sheet 3 from the upper side and slightly sends out the uppermost sheet 3. Here, since the film 205 having a coefficient of friction smaller than that of the sheet pickup roller 204 is adhered through an adhesive onto the circumferential surface of the projection 204d, the sheet 3 is not completely sent out therefrom. Further, since the outer surface of the film 205 is arranged to be lower or equal in height to the stopping roller 7, it is possible to prevent the front portion of the sheet 3 fed from floating before sending it out to the sliding surface of the retard pad 6. FIG. 10B is a cross-sectional view showing the principal portion of the sheet feeding apparatus which takes a sheet-feeding state. In this sheet-feeding state, the front portion of the uppermost sheet 3 is sent out through a frictional force relative to the circumferential surface of the sheet pickup roller 204 and surely pressed against the retard pad 6 by means of the projection 204d. Thus, it is possible to surely and accurately feed only the uppermost sheet 3 because the second and other sheets are controlled by the retard pad 6, thereby preventing the simultaneous supply of the multiple sheets. Thereafter, the sheet 3 fed from the sheet feeding apparatus is supplied through carrying rollers (8) into the laser printer and printing-processed as described above.

Here, even if the projection 204d is arranged to be similar in structure to the guide member 21 in FIG. 3, it is possible to offer the same effect.

Figure 11:
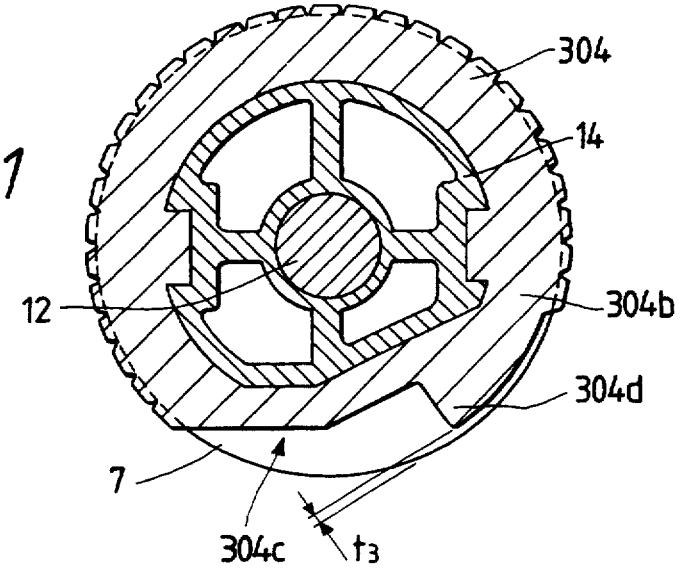
FIG. 11 is a cross-sectional view showing an arrangement of a sheet pickup roller of a sheet feeding apparatus according to a third embodiment of this invention.

Moreover, a description will be made hereinbelow in terms of a third embodiment of this invention. FIG. 11 is a cross-sectional view taken along the line A—A in FIG. 1, showing a sheet pickup roller of a sheet feeding apparatus according to this embodiment where parts corresponding to those in FIG. 3 are marked with the same numerals and the description thereof will be omitted for brevity. In FIG. 11, a sheet pickup roller 304 whose outer portion is made of a rubber or the like has a diameter slightly greater than that of a stopping roller 7 and has a number of grooves 304a extending along its own axis. Further, the sheet pickup roller 304 has a notch portion 304c and a projection 304d at a leading portion which first faces sheets when rotating in a predetermined direction for the pick-up of the sheets. The projection 304d and the sheet pickup roller 304 may be made of the same material and integrally constructed with each other.

Figure 12A:
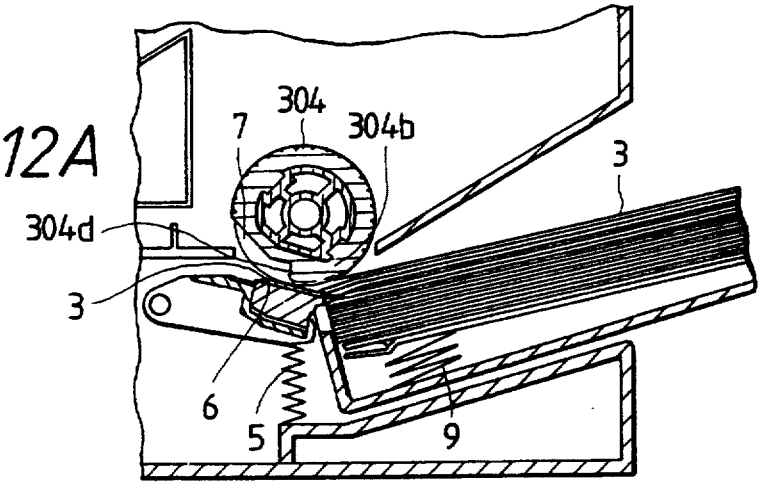
FIGS. 12A and 12B are illustrations of a laser printer equipped with the sheet feeding apparatus according to the third embodiment of this invention.
Figure 12B:
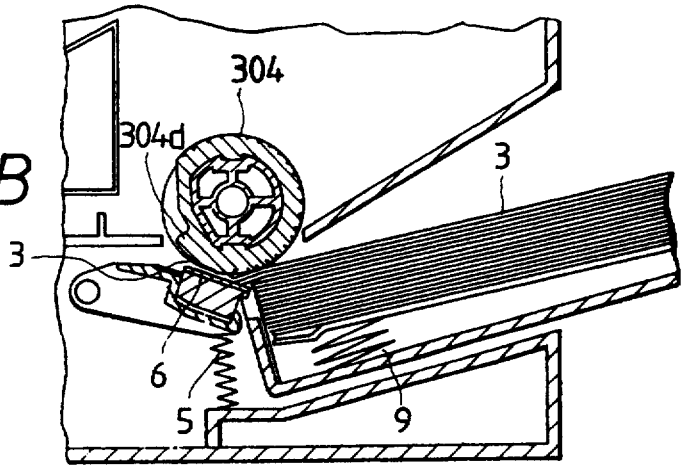
Figure 13:
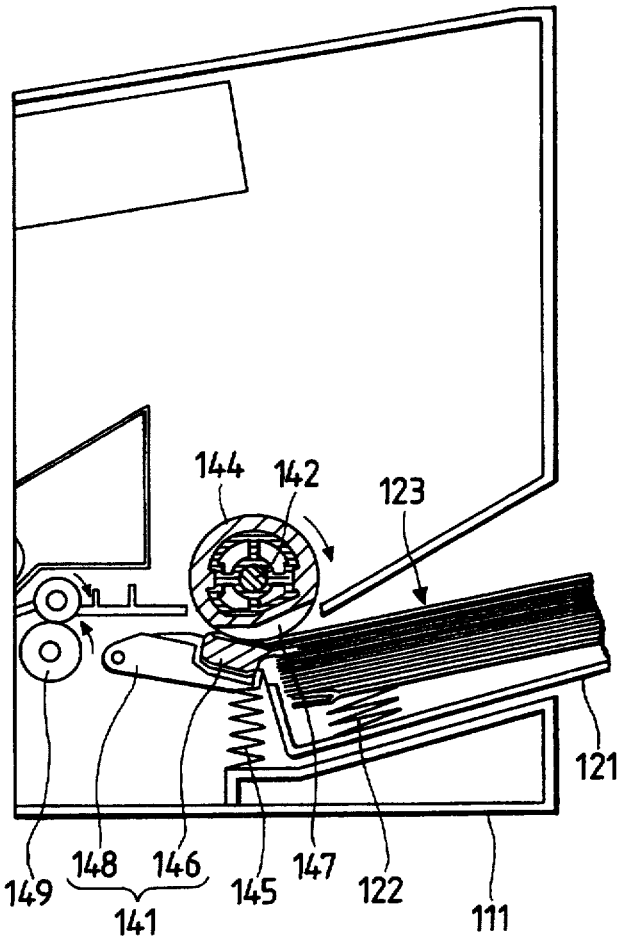
FIG. 13 PRIOR ART
FIGS. 13 to 16 are illustrations for describing a conventional sheet feeding apparatus.
Figure 14:
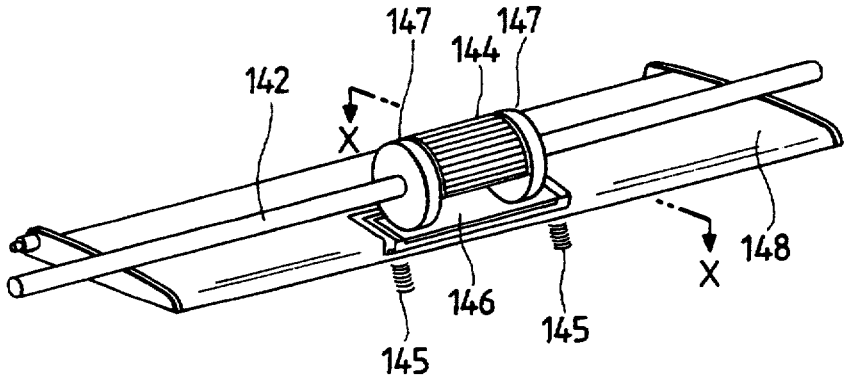
FIG. 14 PRIOR ART
Figure 15:
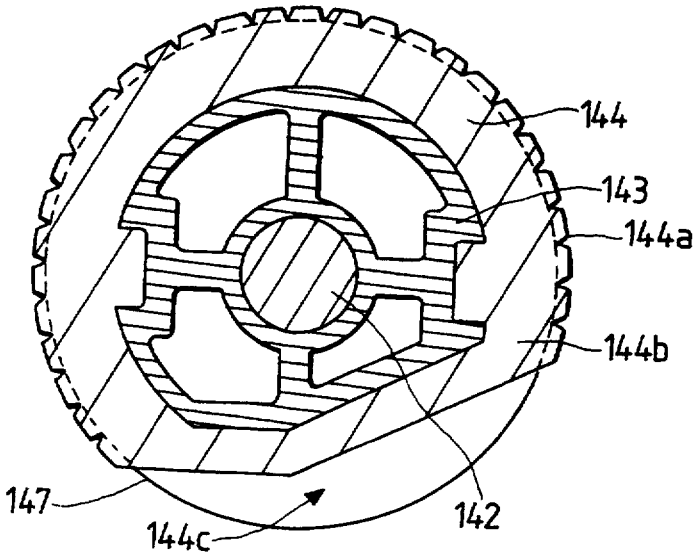
FIG. 15 PRIOR ART
Figure 16:
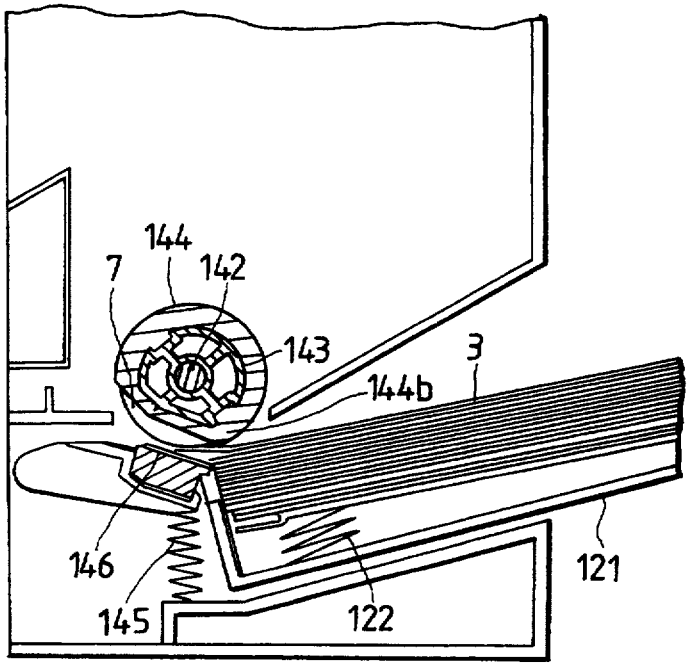
FIG. 16 PRIOR ART

The projection 304d has a circumferential surface (arc-shaped surface) substantially extending along the circumference of the sheet pickup roller 304 or the circumference of the stopping roller 7. The circumferential surface of the projection 304d is arranged to have a diameter smaller than that of the stopping roller 7. Preferably, the lowered amount (t3 in FIG. 11) of the projection 304d is set to be approximately 5 times the thickness of the sheet (3). The projection 304d will be effectively used when its length is set to be equal to a range from the contact point between the projection 304d and a retard pad 6 to the leading portion 304b of the sheet pickup roller 304 in the state that the leading portion 304b of the sheet pickup roller 304 comes into contact with the sheet (3) to be fed. Secondly, a description will be made hereinbelow in terms of an operation of the sheet feeding apparatus for feeding sheets one by one. FIG. 12A is a cross-sectional view showing the principal portion of the sheet feeding apparatus which takes a state immediately after the start of the sheet-feeding operation. In FIG. 12A, the projection 304d first presses the front portion of the uppermost sheet 3 from the upper side and slightly sends out the uppermost sheet 3. Here, since the outer surface of the projection 304d is arranged to be lower in height than the circumferential surface of the stopping roller 7, it is possible to prevent the front portion of the sheet 3 from floating, before guiding it to the sliding surface of the retard pad 6. FIG. 12B is a cross-sectional view showing the principal portion of the sheet feeding apparatus which takes a sheet-feeding state. In this sheet-feeding state, the front portion of the uppermost sheet 3 is sent out through a frictional force relative to the circumferential surface of the sheet pickup roller 304 and surely pressed against the retard pad 6 by means of the projection 304d. Thus, it is possible to surely and accurately feed only the uppermost sheet 3 because the second and other sheets are controlled by the retard pad 6, thereby preventing the simultaneous supply of the multiple sheets. Thereafter, the sheet 3 fed from the sheet feeding apparatus is supplied through carrying rollers (8) into the laser printer and printing-process as described above.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A sheet feeding apparatus for intermittently feeding sheets, comprising:

a sheet pickup roller fixed to a rotatable drive shaft and having a cross section comprising an arc portion and a chord portion to substantially form a semicylindrical configuration;

cylindrical roller means rotatably coupled to said rotatable drive shaft and disposed at both sides of said sheet pickup roller;

a pad biased by elastic means to be pressed against said sheet pickup roller and said cylindrical roller means;

a projection provided at said chord portion of said sheet with said sheet in response to rotation of said sheet pickup roller in a predetermined direction;

wherein a film is adhered onto an outer surface of said projection, said film having a coefficient of friction smaller than a coefficient of friction of said sheet pickup roller.

2. A sheet feeding apparatus as claimed in claim 1, wherein said film is made of a tetrafluoroethylene polymer.

3. A sheet feeding apparatus as claimed in claim 1, wherein an outer surface of said film on said projection is located inwardly from a circumferential portion of said cylindrical roller means in a radial direction of said cylindrical roller means.

4. A sheet feeding apparatus for intermittently feeding sheets, comprising:

a sheet pickup roller fixed to a rotatable drive shaft and having a cross section comprising an arc portion and a chord portion to substantially form a semicylindrical configuration;

cylindrical roller means rotatably coupled to said rotatable drive shaft and disposed at both sides of said sheet pickup roller;

a pad biased by elastic means to be pressed against said sheet pickup roller and said cylindrical roller means; and a guide member provided at said chord portion to extend along an axis of said sheet pickup roller, said guide member has a width to come into contact with said sheet over a range from a contact point between said sheet pickup roller and said pad to one end portion of said arc portion which acts as a leading portion at which said sheet pickup roller initially comes into contact with said sheet when rotating in a predetermined direction.

5. A sheet feeding apparatus as claimed in claim 4, wherein an outer surface of said guide member is positioned to be equal in cross-sectional height from a center axis of said drive shaft to a circumferential portion of said cylindrical roller means or higher than said circumferential portion thereof.

6. A sheet feeding apparatus as claimed in claim 4, wherein said guide member is made of a material having a coefficient of friction smaller than a coefficient of friction of a material of said sheet pickup roller.

7. A sheet feeding apparatus as claimed in claim 4, wherein said guide member is made of one selected from polyacetal resin and alkyl benzene sulfonic acid type resin.

8. A sheet feeding apparatus comprising:

a sheet pickup roller rotatable in a predetermined direction for feeding one of sheet sheets stacked on sheet storage means, in sequence, to a given place;

a member urged to engage said sheet pickup roller to form a nip through which one of the sheets is fed in cooperation with rotation of said sheet pickup roller through an engaging portion with said sheet pickup roller toward the given place; and sheet guiding means, provided on said sheet pickup roller, for guiding a leading edge portion of the one of the sheets stacked on the sheet storage means to the engaging portion of said member at the time of start of a sheet-feeding operation, said sheet guiding means being carried by said sheet pickup roller so as to rotate when said sheet pickup roller rotates to exert pressure on leading edge portions of the sheets stacked on the sheet storage means at a preselected level while allowing a given degree of slippage between said sheet guiding means and the one of the sheets to be guided in disengagement of said sheet pickup roller from the one of the sheets.

9. A sheet feeding apparatus as set forth in claim 8, wherein said sheet guiding means is provided with a guide member which extends over a preselected length of an outer surface of said sheet pickup roller, an outer surface of said guide member being made of a lower friction material than that of said sheet pickup roller.

10. A sheet feeding apparatus as set forth in claim 9, wherein the guide member projects outwardly from the outer surface of said sheet pickup roller in a radial direction of said sheet pickup roller.

11. A sheet feeding apparatus as set forth in claim 8, further comprising a cylindrical roller arranged in a coaxial relation to said sheet pickup roller which has an outer diameter smaller than that of said sheet pickup roller, said sheet guiding means extending over a preselected length of an outer surface of said sheet pickup roller and being lowered from outer surfaces of said sheet pickup roller and said cylindrical roller in a radial direction of said sheet pickup roller.

12. A sheet feeding apparatus as set forth in claim 11, wherein said sheet guiding means is lowered from the outer surface of said cylindrical roller by an interval of approximately 5 times the thickness of the sheet.

13. A sheet feeding apparatus as set forth in claim 8, wherein said sheet pickup roller includes a cylindrical member formed with an arc portion and a chord portion, said sheet guiding means being provided on the chord portions.

14. A sheet feeding apparatus as set forth in claim 13, further comprising a cylindrical roller arranged in a coaxial relation to said sheet pickup roller which has an outer diameter smaller than that of said sheet pickup roller, said sheet guiding means projecting from an outer surface of said cylindrical roller.

15. A sheet feeding apparatus as set forth in claim 14, wherein said sheet guiding means projects from the outer surface of said cylindrical roller by an interval of from 1 to 3 times the thickness of the sheet.

* * * * *